US005509791A

United States Patent [19]

Turner

[11] Patent Number: 5,509,791

[45] Date of Patent: Apr. 23, 1996

[54] VARIABLE DELIVERY PUMP FOR MOLTEN METAL

[76] Inventor: Ogden L. Turner, Parque Residencial Orituco, Torre 2, Apt. 10-C, Calle A, Santa Rosa de Lima, Caracas 1060, Venezuela

[21] Appl. No.: 250,622

[22] Filed: May 27, 1994

[51] Int. Cl.[6] ..... F04B 39/14; F04D 1/14

[52] U.S. Cl. ..... 417/238; 417/424.1; 417/430; 415/88; 415/131

[58] Field of Search ..... 417/238, 424.1, 417/430; 415/88, 89, 129, 131, 200, 211.2, 216.1

[56] References Cited

U.S. PATENT DOCUMENTS

| | | | |
|---|---|---|---|
| 2,468,704 | 4/1949 | Pippen | 415/200 |
| 3,010,402 | 11/1961 | King | 415/131 |
| 3,291,473 | 12/1966 | Sweeney et al. | 415/88 |
| 3,612,715 | 10/1971 | Yedidiah | 415/131 |
| 3,776,660 | 12/1973 | Anderson et al. | 415/200 |
| 3,836,280 | 9/1974 | Koch | 415/200 |
| 4,521,151 | 6/1985 | Frater et al. | 415/131 |
| 4,786,230 | 11/1988 | Thut | 415/88 |
| 5,088,893 | 2/1992 | Gilbert et al. | 415/200 |
| 5,203,681 | 4/1993 | Cooper | 417/424.1 |

*Primary Examiner*—Richard A. Bertsch
*Assistant Examiner*—William Wicker
*Attorney, Agent, or Firm*—Rothwell, Figg, Ernst & Kurz

[57] ABSTRACT

A pump for use in a bath of reactive molten metal such as zinc has a graphite rotor, driven at constant speed, and capable of pumping molten metal at selective rates from the bath. The pump includes an internal delivery flow path and protected drive shaft, so that the liquid metal of the bath is not turbulated by the rotating shaft, and the temperature of the metal within the pump, during semi-quiescent periods is maintained substantially constant. The pump has a robust structure and yet can handle rates as low as 10 to 15 pounds per minute, in contrast to usual types of pumps that require pumping about 80 pounds per minute, and being speed controlled, are less accurate in their delivery rates. An adjustable control for regulating flow rate during operation also is provided.

8 Claims, 4 Drawing Sheets

VARIABLE DELIVERY PUMP FOR MOLTEN METAL

TECHNICAL FIELD

This invention is directed to a pump for pumping molten metal, and in particular to a pump for delivering quantities of reactive metal at uniform controlled rates of flow.

BACKGROUND TO THE INVENTION

In the handling of molten metal, particularly reactive metals such as zinc, great difficulty has been experienced in achieving low flow rates, with accuracy and without contamination.

Molten metals, particularly zinc, are difficult to handle, being extremely hot and chemically highly reactive, and attack stainless steels quite rapidly.

The most generally adopted prior art pumps have included pumps having a graphite rotor and surrounding casing, submerged vertically into a bath of molten metal. These pumps act centrifugally, to deliver the molten metal upwardly through an external vertical discharge pipe, under centrifugal pumping action. This arrangement requires that the rotor operates within a base plate housing, to discharge through the discharge pipe. The rotor drive shaft extends downwardly through the metal in the bath, being generally of graphite, and of significant diameter and in use creating considerable turbulence, so as to entrain dross and other impurities from the surface, some of which are drawn into and delivered with the pump output. This turbulence and entrainment is highly deleterious to an unprotected delivery pipe and other elements of the system. The adoption of a slender shaft of moly-tungsten alloy, in order to mitigate the shaft turbulating effect is so expensive as to double the cost of some pumps.

The rate of delivery is controlled by regulating the speed of the driving motor. In view of the non-linear pumping characteristic in relation to speed, accurate control and constancy of operation are difficult, if not impossible, to achieve.

Furthermore, the prevailing minimum pumping rates are about 80 pounds per minute, which is impossibly high for certain applications, while, also the nature of the pump design results in violent stirring of the molten metal, with consequent entrainment of dross into the delivered molten product.

The known prior art liquid metal pumps are prone to being readily disabled, by "freezing" of the metal within the pump to a solid, entrained mass, particularly in the discharge pipe, due to its exposed nature.

DISCLOSURE OF THE INVENTION

The present invention provides a pumping system for pumping reactive liquids at relatively constant controllable rates, comprising an impeller located within a casing, for immersion in use within the liquid, the casing including a delivery passage for outward and upward delivery of the liquid by the pump, including at least one delivery orifice to receive the pumped liquid, and means to vary the effective flow path, to control the rate of delivery by the pump.

In one preferred embodiment the effective flow path is varied by controlling; the cross-sectional area of the pump delivery. Thus, I provide a stationary flow passage member to receive the reactive liquid in discharged relation from the pump impeller, including provision to modulate the effective flow path thus provided, so as to control the throughput port.

In the preferred embodiment the effective flow path is modulated by positioning the pump rotor, relative to the stationary delivery port, so as to control the out-flow cross-sectional flow path.

A groove may be provided within the stationary flow passage member, interconnecting the discharge ports thereof so as to promote a smooth discharge flow.

The elongated rotor shaft is positioned longitudinally (axially) within a fixed body portion containing the stationary delivery port, by way of shims of selected thickness, so as to achieve a desired extent of axial overlap of the pump rotor delivery port with the inlet of the stationary delivery ports.

In another embodiment a manually adjustable rack and pinion arrangement provides a full range of flow delivery while in operation. The use of an electric or air driven motor, running at a fixed speed, with a selected axial spacer setting maintains the pump delivery substantially constant.

The provision of a housing enclosure for a drive shaft portion of the pump rotor, having a stationary flow path extending axially upwardly within the housing, located radially outwardly of the pump rotor, ensures an absence of stirring action by the full extent of the pump shaft on the reactive liquid bath.

The liquid inlet to the pump impeller is located centrally thereof, at the bottom of the rotor, near the bottom of the bath so as to ensure the ingress of liquid furthest removed from the surface of the bath in which the pump is located. Thus, the pumped liquid is the purest available within the bath, being farthest removed from, and having the maximum separation time from dross and other impurities or gases, which tend to migrate upwardly through the bath.

In one use, the pump rotor may be positioned below the housing, thereby discharging laterally, to promote local stirring of the bath, without changes of the entrainment of dross from the surface of the bath.

In the case of highly chemically active bath liquids, such as zinc and aluminum, the preferred pump rotor, stationary delivery port and pump casing are all of graphite, which is highly resistant to erosion and corrosion by the liquid metal. Moly-tungsten alloy also may be used.

The provision of a closed pump housing with the enclosed drive shaft of the first embodiment enables the ready introduction of an inert gas such as nitrogen to displace the atmosphere within certain portions of the pump and thereby substantially eliminate oxidation activity therein, in the presence of the molten metal.

BRIEF DESCRIPTION OF THE DRAWINGS

Certain embodiments of the invention are described by way of illustration, without limiting the scope of the present invention thereto, as follows.

DETAILED DESCRIPTION OF THE PREFERRED INVENTION

Figure 1:
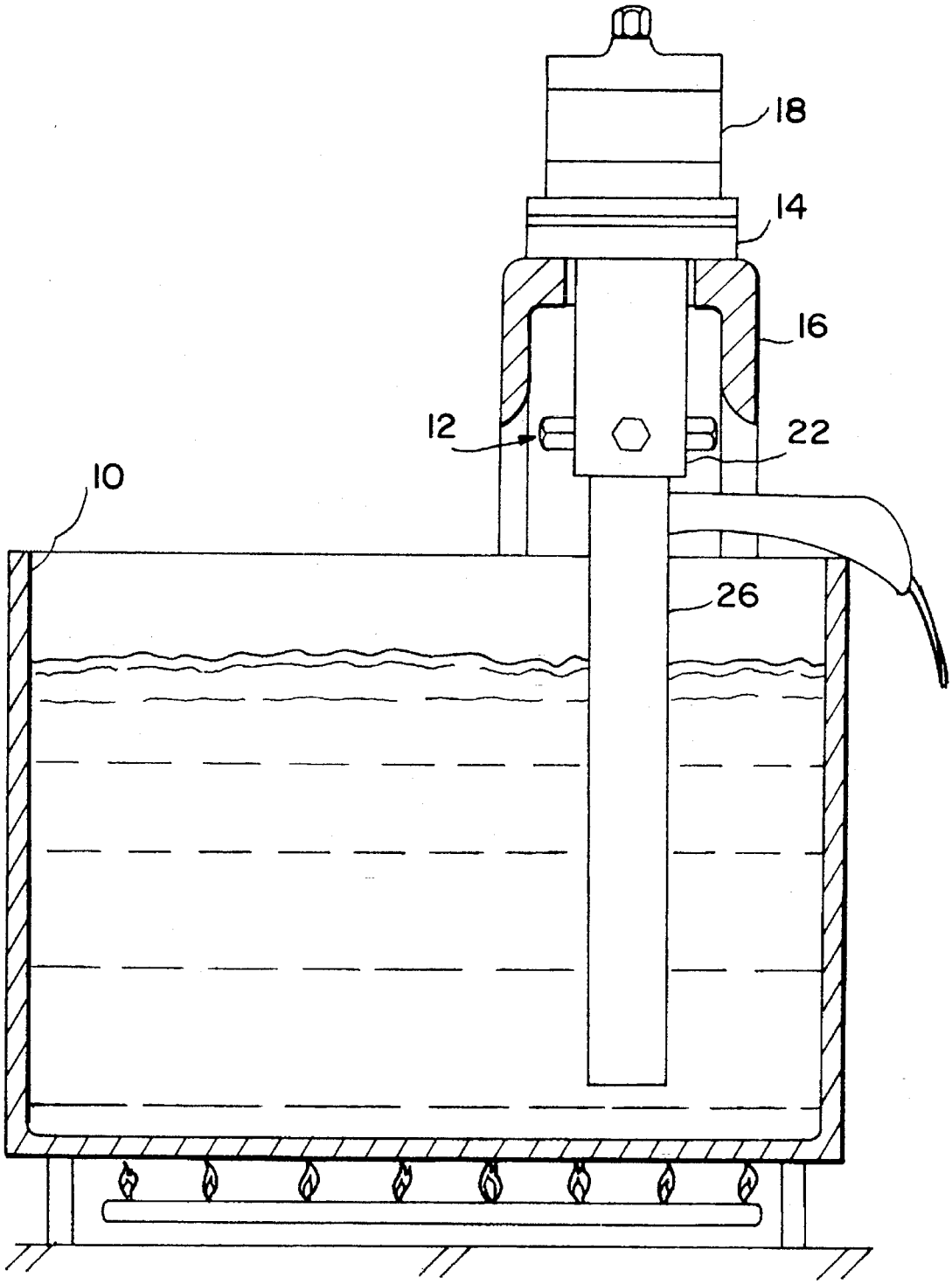
FIG. 1 is a side elevational view, partially sectioned, of a tank having a pump in accordance with the present invention installed therein.

Referring to FIG. 1, the tank 10 is a heated tank to receive and maintain molten a substance, such as zinc or aluminum. A pump 12 in accordance with the present invention is mounted by the top flange 14 upon a raised bridge 16 that spans the bath and may be used to locate a plurality of such pumps along its length.

An electric or air motor 18 is shown mounted atop the pump 12, in driving relation therewith.

Figure 2:
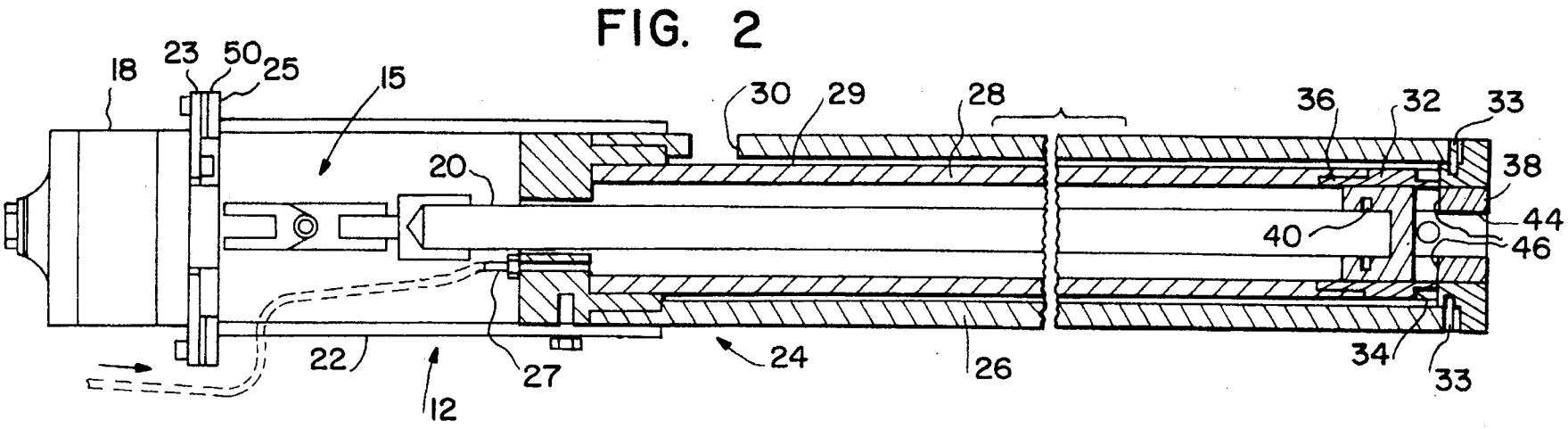
FIG. 2 is a side view, in diametrical section of a subject pump (on its side)
Figure 4:
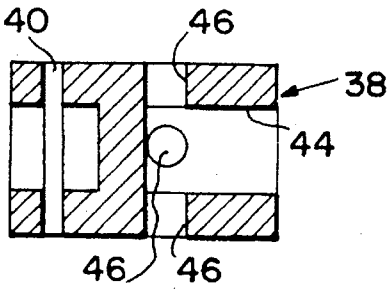
FIGS. 3 and 4 are enlarged diametrical section views of the modulator and pump rotor, respectively.
Figure 3:
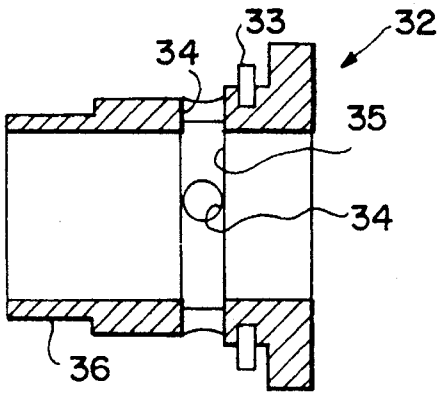

Referring to FIGS. 2, 3 and 4 the pump 12 has a universal joint 15 coupling the motor 18 to the pump shaft 20 which extends axially downwardly substantially the full length of the pump casing. The shaft 20 is preferably of graphite. However, it will be understood that a moly-tungsten shaft can be used in a zinc bath installation.

The upper casing portion 22 of pump 12 may be of metal, such as steel, having the lower graphite casing portion 24 bolted thereto.

The composite graphite casing 24 has an outer cylindrical portion 26 and an inner cylindrical portion 28, forming an annular passage 29 therebetween extending up to a delivery port 30.

At the lower end of the pump 12 a stationary delivery modulator 32 is pinned at 33 in the open end of the outer casing 26. The delivery modulator 32 has a plurality of radially extending sized flow ports 34, having an inner peripheral groove 35 in interconnecting relation therebetween.

A cylindrical collar portion 36 of modulator 32 extends axially upwardly in entered, substantially sealing relation within a stepped end portion of the inner cylindrical portion 28.

A graphite rotor portion 38, pinned at 40 to the lower end of rotor shaft 20, fits within the modulator 32.

The rotor portion 38 has a centrally located axially extending flow entry 44 connecting with radial discharge ports 46.

The upper end of rotor portion 38 fits as a snug running fit within the inner diameter of the stationary modulator 32.

The rotor discharge ports 46 are in substantially axially coincident relation with the stationary groove 35 and flow ports 34 of modulator 32.

The vertical location of the rotor portion 38 relative to the modulator 32 may be readily varied. In the preferred embodiment a shimstock 50 of desired thickness may be inserted between the flange 23 of the motor 18 and the flange 25 of the pump upper casing 22, in precise, axial spacing relation therebetween, so as to achieve the desired delivery modulation.

The effect of the insert of shimstock 50 of selected= thickness is to move the motor 18, shaft 20 and pump rotor 38 axially upwardly, relative to the fixed modulator 32. This introduces a corresponding axial misalignment of the rotor discharge ports 46 with the modulator groove 35 and ports, causing a change in the outflow characteristics of the pump 12, so as to modify accordingly the rate of pump delivery.

Shown in FIG. 2 is a gas fitting 27 connecting with the annular space surrounding the shaft 20. An inert gas supply of nitrogen or the like by way of a tube is shown in phantom, in connected relation to the fitting 27.

Figure 5:
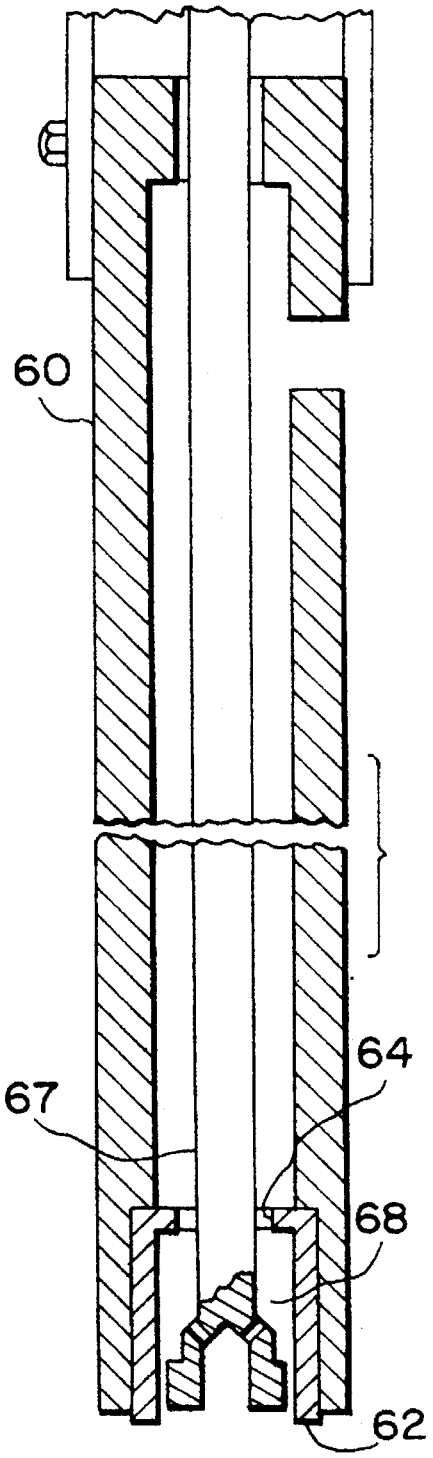
FIG. 5 is a view in diametrical section of the pump portion of a second embodiment of the invention.
Figure 6:
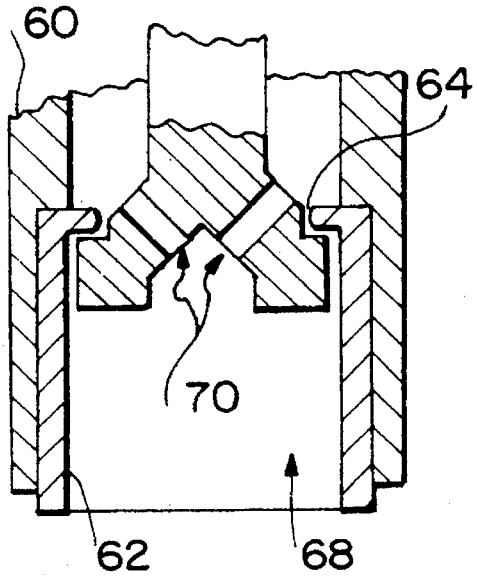
FIG. 6 is an enlarged view of a portion of FIG. 5.
Figure 7:
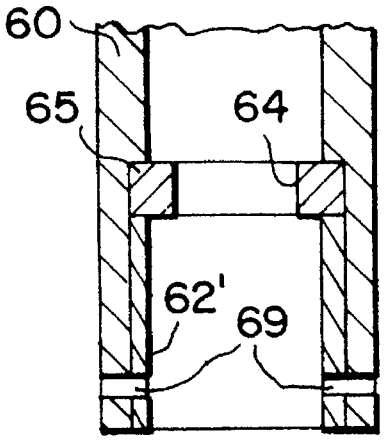
FIG. 7 is a view similar to a portion of FIG. 6, for a modified throttle.

Referring to the second embodiment as illustrated in FIGS. 5, 6, and 7, the mounting of the drive motor, and the suspension of the pump over the bath may be the same as for the embodiment shown in FIG. 1.

The graphite casing 60 of the pump second embodiment has an insert bushing 62 at the lower end thereof. The bushing 62 has a constricted bore 64 through which the pump shaft 66 is passed. The lower end 67 of shaft 66 is illustrated as being tapered, for flow control purposes.

The pump rotor 68 has a plurality of inclined passages 70, through which in use, the liquid metal is discharged. In the position illustrated in FIG. 5 the flow is minimized.

Repositioning of the pump rotor 68 upwardly, in the manner taught above in regard to the first embodiment, permits progressively increased flow through the throttle bore 64.

Referring to FIG. 6, with the rotor 68 shown in its uppermost position, the throttle bore 64 becomes substantially ineffective, and full pump delivery is achieved.

It will be understood that complementary annular throttle lands in the form of protruding shoulders may be provided upon the pump shaft 66, to achieve a co-operative throttling effect.

In FIG. 7 a throttle plate 65 of moly-tungsten alloy is positioned by graphite bushing 62'. The bushing 62' is pinned at 69 to the casing 60.

It will be understood that the preferred arrangement of this invention maybe modified, within the scope of the appended claims.

Figure 8:
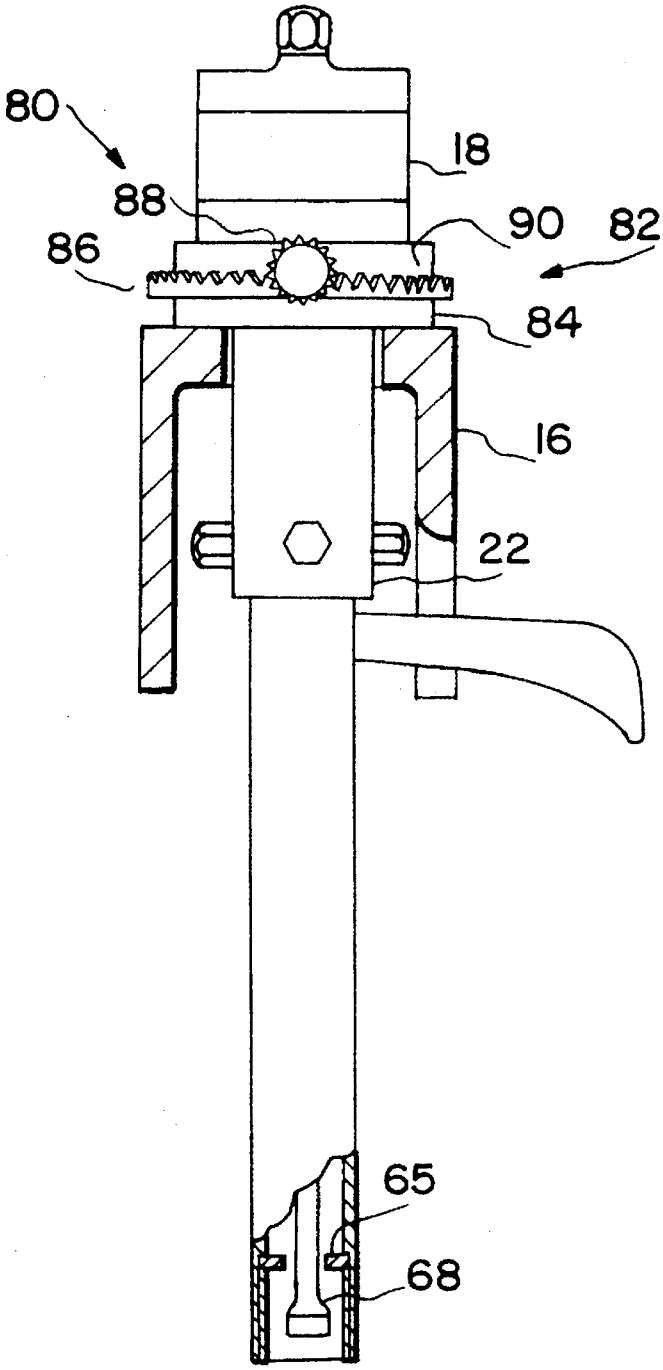
FIG. 8 is a side elevational view, partially sectioned of a pump embodiment incorporating variable flow adjustment provisions.

Referring to FIG. 8, the pump 80 in accordance with the invention is illustrated as having a throttle plate 65 in cooperating relation with a rotor 68, of the type shown in FIGS. 5, 6 and 7.

It will be understood that manual adjustment means 82 herein illustrated is equally readily used with a pump of the type illustrated in FIGS. 1 through 4. The manual flow adjustment means 82 comprises a lower spacer ring 84 having an annular toothed rack 86 extending outwardly therefrom and engaged by a pinion connected to handwheel 88. The handwheel 88 is rotatably mounted in the motor housing 18.

A pair of ramp surfaces 90 separates the ring 84 from the motor 18. In use, rotation of handwheel 88 rotates the attached pinion in rotational driving relation with the annular rack 86, causing the rack 86 to rotate the tapered lower spacer ring 84. This produces rotational displacement at the ramp surfaces 90, to axially displace rotor 68 relative to the throttle ring 65 thereby moderating the rate of delivery of the pump. The extent of motion of ramp surface 90 may be regulated by stops, not shown, to preclude contact of rotor 68 with throttle 65.

Figure 9:
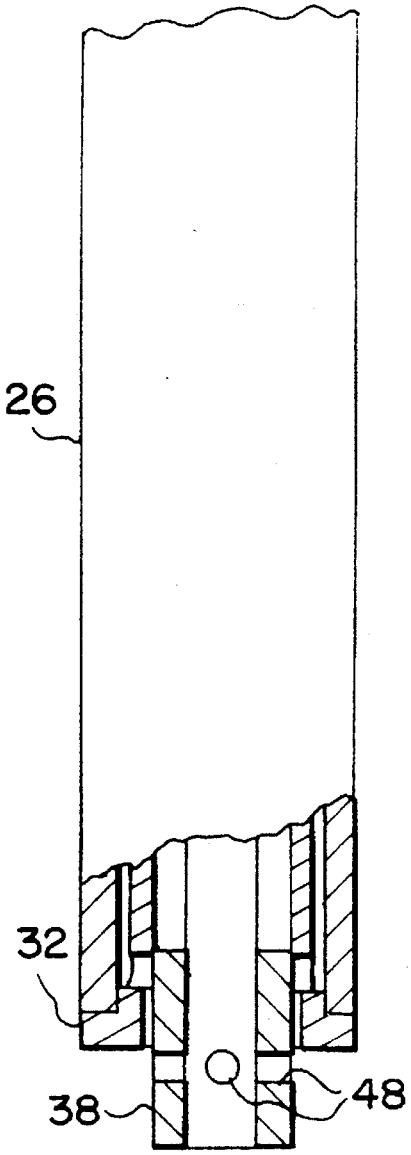
FIG. 9 is a side elevational view, partially sectioned of a lower portion of a pump of the FIG. 2 embodiment, in a bath-stirring configuration.

Referring to FIG. 9, a lower portion 26 of a pump of the type shown in FIGS. 1–4 is shown, having the rotor portion 38 thereof extending below the modulator 32, such that the discharge posts 46 are clear of the modulator 32. In this condition, operation of the pump promotes strong local circulation in the adjacent reaches of the liquid metal bath.

In the case of a bath containing metal alloys, this ensures intimate mixing of the liquid alloys, there being virtually no tendency to draw down or entrain dross and other surface impurities.

This pump configuration for local circulation is also available in the FIGS. 5 through 8 embodiment, although a greater component of vertical mixing then occurs.

In a bath having a plurality of pumps one or more of the pumps may be utilized for purposes of mixing the molten bath material. In addition to ensuring thorough mixing of the bath liquid, the effects of thermal gradients can be mitigated.

What is claimed:

1. A delivery pump for pumping reactive material from within a bath containing said reactive material, and into which the pump is immersed, said pump having an elongated housing having a motor at the upper end thereof, said housing containing an elongated drive shaft having a pump rotor secured to the lower end thereof, and an upwardly extending delivery passage within the housing substantially concentric with the drive shaft and connecting with a laterally extending delivery means, and flow modulator means comprising an annular ring having a plurality of outwardly directed passages for passage of said liquid material therethrough in flow moderating relation therewith, said rotor serving to partly block said passages in at least one axially located position thereof, wherein said axial location of said rotor relative to said flow modulator means may be selectively controlled.

2. The pump as set forth in claim 1, wherein said rotor outwardly directed passages comprises a plurality of passages in mutual, peripherally spaced relation extending upwardly and outwardly through a crown portion of said rotor.

3. The pump as set forth in claim 2, said rotor having an annular recess adjacent said passages to receive said annular ring in at least partially entered relating therein and below outlet portions of said plurality of passages, to substantially preclude a throttling influence by said annular ring on the output of said pump.

4. The pump as set forth in claim 2, said rotor having an annular recess adjacent said passages to receive said annular ring in at least partially entered relation therein and below outlet portions of said plurality of passages, to substantially preclude a throttling influence by said annular ring on the output of said pump, in combination with said bath, wherein said bath comprises a bath for molten material.

5. A delivery pump for pumping liquid reactive material from within a bath containing said reactive material and into which the pump is immersed, said pump having a rotatable rotor, a housing having a motor at the upper end thereof and said rotor adjacent the lower end of the housing, shaft means within the housing connecting the motor in driving relation with the rotor, and delivery means including a passage within the housing, in use to deliver the liquid reactive material upwardly to a location outside the bath, said pump including flow modulator means comprising a stationary annular member enclosing at least a portion of the rotor, and manually operable adjustment means for adjusting said flow modulator means including an inclined annular ramp, wherein relative rotational displacement between opposed face portions of said ramp produces axial displacement of said pump rotor relative to said housing.

6. The pump as set forth in claim 5, said manually operable adjustment means including a rack and pinion, and a control handle in rotational controlling relation with said pinion.

7. A delivery pump for pumping liquid reactive material from within a bath containing said reactive material, and into which the pump is immersed, in combination with said bath, wherein said pump has a rotatable rotor having delivery passages therein, a housing having a motor at the upper end thereof and said rotor adjacent the lower end of the housing, shaft means within the housing connecting the motor in driving relation with the rotor and delivery means including a passage within the housing, substantially co-axial with said shaft means, in use to deliver said liquid reactive material upwardly to a location outside the bath, and pump adjustment means permitting positioning of said rotor downwardly below said housing, in use to circulate said liquid material externally of said housing.

8. A delivery pump for pumping liquid reactive material from within a bath containing said reactive material, and into which the pump is immersed, said pump having an elongated housing having a motor at an upper end thereof, said housing containing an elongated drive shaft having a pump rotator secured to the lower end thereof and extending downwardly below said housing, having delivery passages therein, in use to circulate said liquid material externally of said housing, and an upwardly extending delivery passage within the housing substantially concentric with said drive shaft and connecting with a laterally extending delivery means, and flow modulator means including flow modulator adjustment means to enable a range of adjustment to the rate of pumping, in use to control the rate of delivery of said liquid reactive material upwardly to a location outside the bath.

* * * * *